US011326284B2

(12) United States Patent
Arai

(10) Patent No.: US 11,326,284 B2
(45) Date of Patent: May 10, 2022

(54) DOUBLE-NEEDLE LOCKSTITCH SEWING MACHINE

(71) Applicant: TECHNICA CO., LTD., Gunma (JP)

(72) Inventor: Takeo Arai, Gunma (JP)

(73) Assignee: TECHNICA CO., LTD., Gunma (JP)

( * ) Notice: Subject to any disclaimer, the term of this patent is extended or adjusted under 35 U.S.C. 154(b) by 0 days.

(21) Appl. No.: 17/048,812

(22) PCT Filed: Jun. 22, 2018

(86) PCT No.: PCT/JP2018/023816
§ 371 (c)(1),
(2) Date: Oct. 19, 2020

(87) PCT Pub. No.: WO2019/244342
PCT Pub. Date: Dec. 26, 2019

(65) Prior Publication Data

US 2021/0164141 A1 Jun. 3, 2021

(51) Int. Cl.
*D05B 1/14* (2006.01)
*D05B 57/36* (2006.01)
(Continued)

(52) U.S. Cl.
CPC ..... *D05B 1/14* (2013.01); *D05B 57/143* (2013.01); *D05B 57/36* (2013.01); *D05B 73/06* (2013.01); *D05B 93/00* (2013.01)

(58) Field of Classification Search
CPC .... D05B 1/00; D05B 1/08–24; D05B 57/143; D05B 57/00–38; D05B 73/06; D05B 93/00
See application file for complete search history.

(56) References Cited

U.S. PATENT DOCUMENTS 1,150,123 A 8/1915 Jerram
1,917,756 A * 7/1933 Eames ..... D05B 15/02 112/258
(Continued)

FOREIGN PATENT DOCUMENTS

CN 2444971 Y 8/2001
CN 1412374 A 4/2003
(Continued)

OTHER PUBLICATIONS

International Search Report Issued in Patent Application No. PCT/JP2018/023816 dated Aug. 7, 2018.

*Primary Examiner* — Ismael Izaguirre
(74) *Attorney, Agent, or Firm* — Pearne & Gordon LLP

(57) ABSTRACT

Provided is a double-needle lockstitch sewing machine that can easily sew a fabric rolled into a tubular shape by two rows of lockstitch. The double-needle lockstitch sewing machine includes: a pair of needles (9) that reciprocates in an up-down direction; a pair of loop catchers (40) that is arranged respectively corresponding to the pair of needles (9) and that catch loops of needle threads formed by the needles (9) by rotating about hook shafts (41) extending in the up-down direction; a lower shaft (20) that is disposed in front of the needles (9) and the loop catchers (40) in the cloth feeding direction and extends in the left-right direction and that rotates in conjunction with a main shaft (10) that drives the needles (9); and connecting shafts (30) that extend in the cloth feeding direction and are connected to the lower shaft (20) and the hook shafts (41) in a power transmittable manner to rotate. The loop catchers (40) are rotationally driven in conjunction with an up and down movement of the needles (9) as a rotational power of the lower shaft (20) is transmitted to the hook shafts (41) via the connecting shafts
(Continued)

(30). Thus, it is possible to easily sew a tubular article with two rows of lockstitch seams.

4 Claims, 14 Drawing Sheets

(51) Int. Cl.

| | |
|---|---|
| ***D05B 73/06*** | (2006.01) |
| ***D05B 93/00*** | (2006.01) |
| ***D05B 57/14*** | (2006.01) |

(56) References Cited

U.S. PATENT DOCUMENTS

| | | | | | |
|---|---|---|---|---|---|
| 2,367,813 | A * | 1/1945 | Wesson | D05B 73/04 | 112/260 |
| 3,875,877 | A | 4/1975 | Fox | | |
| 3,911,841 | A | 10/1975 | Johnson | | |
| 4,043,283 | A * | 8/1977 | Jung | D05B 3/20 | 112/163 |
| 4,989,527 | A * | 2/1991 | Off | D05B 29/08 | 112/104 |
| 6,305,304 | B1 * | 10/2001 | Tanaka | D05B 69/24 | 112/163 |

FOREIGN PATENT DOCUMENTS

| | | | |
|---|---|---|---|
| CN | 201354413 | Y | 12/2009 |
| CN | 101736536 | A | 6/2010 |
| CN | 101736537 | A | 6/2010 |
| CN | 104911837 | A | 9/2015 |
| CN | 105220373 | A | 1/2016 |
| JP | S60-185584 | A | 9/1985 |
| JP | H04-24084 | A | 1/1992 |
| JP | H06-134166 | A | 5/1994 |
| JP | H11-235492 | A | 8/1999 |
| JP | 2000-061184 | A | 2/2000 |
| JP | 2003-111991 | A | 4/2003 |
| JP | 2004-147713 | A | 5/2004 |
| JP | 2010-115359 | A | 5/2010 |

* cited by examiner

DOUBLE-NEEDLE LOCKSTITCH SEWING MACHINE

TECHNICAL FIELD

The present invention relates to a double-needle lockstitch sewing machine, and more specifically to the double-needle lockstitch sewing machine suitable for sewing a tubular article.

BACKGROUND ART

Conventionally, a double-needle lockstitch sewing machine is known (for example, PATENT LITERATURE 1 and PATENT LITERATURE 2). This double-needle lockstitch sewing machine includes two needles and loop catchers arranged respectively corresponding to the two needles. The double-needle lockstitch sewing machine forms two rows of lockstitch seams by cooperation of the two needles and two loop catchers.

In this type of double-needle lockstitch sewing machine, an upper arm portion is provided with a main shaft for moving the two needles up and down. In addition, a bed portion is provided with a lower shaft for rotating the two loop catchers. The lower shaft is provided below the upper arm portion on which the main shaft is provided. The lower shaft is disposed substantially parallel to the main shaft and substantially perpendicular to a cloth feeding direction. The lower shaft is connected to the main shaft and rotates.

The loop catchers are provided on the bed portion below a jaw portion in which the two needles are provided so that hook shafts, which are their rotating shafts, are substantially vertical. For example, as disclosed in PATENT LITERATURE 1, the lower shaft and the hook shafts are connected to be able to transmit power via spiral gears or the like. Thus, the two loop catchers rotate in conjunction with the two needles that move up and down.

As another conventional technique, a loop stitch sewing machine dedicated to sewing the tubular article and used for sewing the tubular article is known (for example, PATENT LITERATURE 3).

The bed portion of this type of loop stitch sewing machine has a lower arm portion formed to extend in the cloth feeding direction so as to be substantially perpendicular to the upper arm portion. The lower arm portion extends to below the jaw portion where the needle is placed. Near a tip of the lower arm portion, there are provided a needle guide member disposed corresponding to the needle, a looper for catching a thread, a feed dog for feeding a cloth, and the like.

In such a configuration, a fabric is rolled into a tubular shape so as to wrap the lower arm portion, and opposing sides in an axial direction of the fabric rolled into the tubular shape are sewn together, so that the tubular article can be easily sewn. That is, according to the loop stitch sewing machine dedicated to sewing the tubular article, the tubular article can be sewn in the axial direction.

CITATION LIST

Patent Literature

PATENT LITERATURE 1: JP-A-60-185584

PATENT LITERATURE 2: JP-A-2003-111991

PATENT LITERATURE 3: JP-A-4-024084

SUMMARY OF INVENTION

Problems to be Solved by Invention

However, the conventional double-needle lockstitch sewing machine disclosed in PATENT LITERATURE 1 or PATENT LITERATURE 2 has a problem that it is difficult to sew the tubular article.

More specifically, in the above-mentioned conventional double-needle lockstitch sewing machine, the lower shaft for rotating the loop catcher is provided substantially directly below the upper arm portion, and the bed is formed in a substantially rectangular shape. Therefore, when sewing a tubular article having a relatively small diameter, for example such as a sleeve of clothing, the fabric hits the bed. Therefore, it is not possible to feed a portion to be sewn of the fabric rolled into the tubular shape to a predetermined position below the needle.

On the other hand, in the loop stitch sewing machine dedicated to sewing the tubular article such as a double loop sewing arm sewing machine disclosed in PATENT LITERATURE 3, it is possible to sew the tubular article having a relatively small diameter such as the sleeve of clothing. However, this type of loop stitch sewing machine sews the fabric by loop stitching. Therefore, the seam thus formed is a seam of loop stitching. That is, with this type of loop stitch sewing machine, the lockstitch seam could not be formed. Further, conventionally, there has not been a double-needle lockstitch sewing machine dedicated to sewing the tubular article, which can sew the tubular article by lockstitch.

The present invention has been made in view of the above circumstances. An object of the present invention is to provide the double-needle lockstitch sewing machine suitable for sewing the tubular article, which can easily sew the fabric rolled into the tubular shape by two rows of lockstitch.

Solution to Problems

A double-needle lockstitch sewing machine includes: a pair of needles that are arranged at a predetermined interval in a left-right direction with respect to a cloth feeding direction and reciprocate in an up-down direction; a pair of loop catchers that is arranged respectively corresponding to the pair of needles and that catch loops of needle threads formed by the needles by rotating about hook shafts extending in the up-down direction; a lower shaft that is disposed in front of the needles and the loop catchers in the cloth feeding direction and extends in the left-right direction and that rotates in conjunction with a main shaft that drives the needles; and connecting shafts that extend in the cloth feeding direction and are connected to the lower shaft and the hook shafts in a power transmittable manner to rotate. The loop catchers are rotationally driven in conjunction with an up and down movement of the needles as a rotational power of the lower shaft is transmitted to the hook shafts via the connecting shafts.

Effects of Invention

The double-needle lockstitch sewing machine of the present invention includes the pair of needles and the pair of loop catchers arranged respectively corresponding to the pair of needles. The loop catchers are configured to rotate about the hook shafts extending in the up-down direction. The lower shaft that extends in the left-right direction and rotates in conjunction with the main shaft that drives the needles is provided in front of the needles and the loop catchers in the cloth feeding direction. Further, between the lower shaft and the hook shafts, there are provided the connecting shafts that extend in the cloth feeding direction and are connected to the lower shaft and the hook shafts in a power transmittable manner to rotate. With such a configuration, the rotational power of the lower shaft is transmitted to the hook shafts via the connecting shafts. The loop catchers are rotationally driven in conjunction with the up and down movement of the needles. Then, the pair of loop catchers respectively catches the loops of the needle threads formed by the pair of needles. Thus, two rows of lockstitch seams are formed.

As described above, in the double-needle lockstitch sewing machine of the present invention, the lower shaft for rotating the loop catchers is provided in front of the needles and the loop catchers in the cloth feeding direction. Further, the loop catchers are rotationally driven via the connecting shafts extending in the cloth feeding direction. Therefore, in the bed portion of the double-needle lockstitch sewing machine of the present invention, it is possible to secure a space for feeding the fabric in the left and right near the needles and the loop catchers, where the fabric is sewn. That is, by disposing the lower shaft in a bed front portion, it is possible to secure a space for passing the fabric behind the lower shaft and below the main shaft. Thus, when sewing the tubular article, the fabric that is rolled into the tubular shape and fed is less likely to hit the bed portion. That is, since the bed portion does not get in the way, even the tubular article having a relatively small diameter, for example such as the sleeve of clothing, can be easily sewn. As described above, according to the present invention, the double-needle lockstitch sewing machine suitable for sewing the tubular article can be obtained.

As described above, according to the double-needle lockstitch sewing machine of the present invention, the tubular article such as the sleeve of clothing, which was conventionally sewn by loop stitching, can be easily formed by lockstitch. The tubular article formed by lockstitch in this way has less sewing threads exposed from the fabric and has high sewing strength. That is, according to the double-needle lockstitch sewing machine of the present invention, it is possible to sew the tubular article with lockstitch seams, which is suitable for the sleeve of sportswear or the like, and is durable and nice and soft.

Further, the double-needle lockstitch sewing machine according to the present invention may include: a bed portion in which the lower shaft is disposed; a support column erected upward from the bed portion; an upper arm portion that is provided on an upper portion of the support column, extends in the left-right direction, and has the main shaft disposed therein; and a jaw portion provided near a tip of the upper arm portion and on which the needles are arranged. The bed portion may have a lower arm portion formed to extend in the cloth feeding direction from a bed front portion in which the lower shaft is disposed, and to reach below the jaw portion, and the connecting shafts are arranged inside the lower arm portion, and the loop catchers may be arranged near a tip of the lower arm portion. With such a configuration, it is possible to roll the fabric into the tubular shape so as to wrap the lower arm portion, and to feed the opposing sides in the axial direction of the fabric rolled into the tubular shape to near the tip of the lower arm portion where the needles and the loop catchers are arranged. Thus, the tubular article can be easily sewn by sewing the opposing sides of the fabric rolled into the tubular shape.

Further, according to the double-needle lockstitch sewing machine of the present invention, the connecting shafts may be connected to the lower shaft and the hook shafts via gears. Thus, the rotational power of the lower shaft can be efficiently and accurately transmitted to the hook shafts, and the loop catchers can be rotated with high accuracy. Therefore, suitable lockstitch seams can be formed.

Further, according to the double-needle lockstitch sewing machine according to the present invention, the connecting shaft may have a drive shaft portion connected to the lower shaft, a driven shaft portion connected to the hook shaft, and a joint portion that connects the drive shaft portion and the driven shaft portion with a variable shaft relative angle. Thus, even when an arrangement interval of the pair of loop catchers is changed, the rotational power can be accurately transmitted from the lower shaft to the hook shafts by changing the shaft relative angle between the drive shaft and the driven shaft.

Further, according to the double-needle lockstitch sewing machine according to the present invention, the double-needle lockstitch sewing machine may include a pair of hook receiving blocks configured such that the loop catchers are respectively arranged therein and at least one of them is movable; an urging unit that urges the pair of hook receiving blocks in a direction that reduces an arrangement interval thereof; and an adjusting unit that adjusts the arrangement interval of the pair of hook receiving blocks. The arrangement interval of the pair of loop catchers can be changed. With such a configuration, the arrangement interval of the pair of loop catchers can be easily increased by moving the pair of hook receiving blocks by the adjusting unit. Further, the arrangement interval of the pair of loop catchers can be easily reduced by adjusting the arrangement interval of the pair of hook receiving blocks in a reducing direction by the adjusting unit and by bringing the pair of hook receiving blocks closer by the urging unit. In this way, the arrangement interval of the loop catchers can be easily adjusted. Thus, the suitable lockstitch seams can be formed.

DESCRIPTION OF EMBODIMENTS

Hereinafter, a double-needle lockstitch sewing machine according to an embodiment of the present invention will be described in detail with reference to the drawings.

Figure 1:
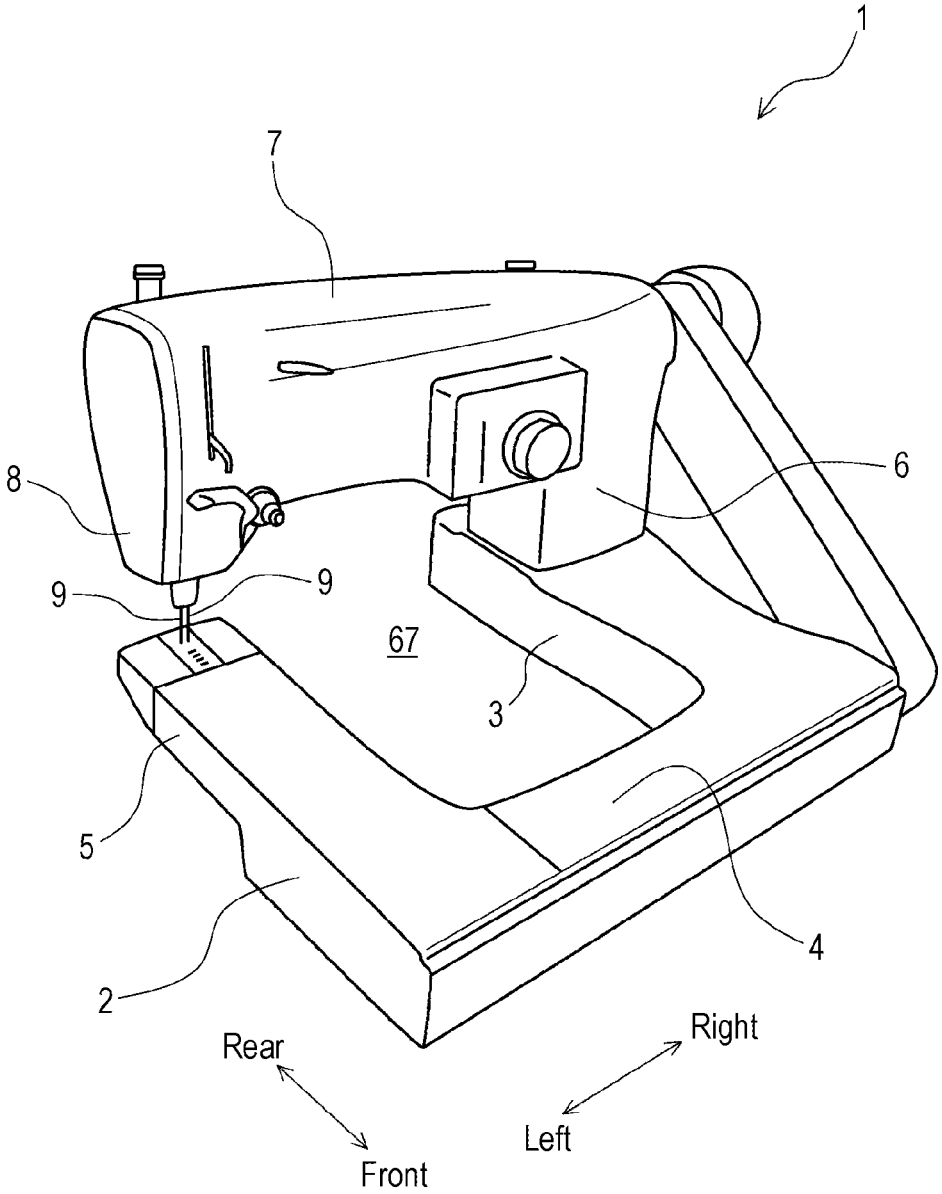
FIG. 1 is a perspective view of a double-needle lockstitch sewing machine according to an embodiment of the present invention.

FIG. 1 is a perspective view of a double-needle lockstitch sewing machine 1 according to the embodiment of the present invention. In the following description, a front side in a cloth feeding direction is referred to as "front" and a rear side is referred to as "rear" as appropriate. Further, "left" and "right", which are appropriately used in the description, are directions based on a state facing the cloth feeding direction.

The double-needle lockstitch sewing machine 1 is a lockstitch sewing machine suitable for sewing a tubular article such as a sleeve of clothing. As illustrated in FIG. 1, the double-needle lockstitch sewing machine 1 employs a frame configuration including a bed portion 2, a support column 6 erected upward from the bed portion 2, an upper arm portion 7 provided on an upper portion of the support column 6, and a jaw portion 8 which is provided near a tip of the upper arm portion 7 and on which needles 9 are arranged.

The bed portion 2 is a portion that supports the double-needle lockstitch sewing machine 1 provided on a sewing machine table or the like (not shown). The bed portion 2 has a base portion 3, a bed front portion 4, and a lower arm portion 5. The base 3 extends in the cloth feeding direction, that is, in a front-rear direction. The support column 6 is erected on an upper surface of the base portion 3. The bed front portion 4 is continuously formed from near a front end of the base portion 3 and extends to the left. The lower arm portion 5 extends from near a left end of the bed front portion 4 in the cloth feeding direction, that is, rearwardly. In other words, a recess 67 having an opening at the rear is formed between the base portion 3 and the lower arm portion 5 of the bed portion 2. Thus, the bed portion 2 has a substantially U-shape in a plan view.

The support column 6 is erected on the upper surface of the bed portion 2, specifically, on the upper surface near a rear end of the base portion 3. The upper arm portion 7 is formed near an upper end of the support column 6. The upper arm portion 7 is formed continuously from the support column 6. The upper arm portion 7 extends in a left-right direction so as to be substantially horizontal and substantially perpendicular to the cloth feeding direction. Inside the upper arm portion 7, a main shaft 10 (see FIG. 3), which will be described below, is provided for driving the needles 9.

The jaw portion 8 is formed near the tip of the upper arm portion 7. The jaw portion 8 extends continuously downward from the upper arm portion 7. A needle driving link mechanism 11 (see FIG. 3) is provided inside the jaw portion 8. Below the jaw portion 8, a pair of needles 9 connected to the needle driving link mechanism 11 is arranged substantially vertically so as to be reciprocable in an up-down direction.

The bed front portion 4 of the bed portion 2 is located in front of the upper arm portion 7. Inside the bed front portion 4, a lower shaft 20 (see FIG. 3) extending in the left-right direction is provided. The lower arm portion 5 extending rearward from the bed front portion 4 reaches below the jaw portion 8. Inside the lower arm portion 5, connecting shafts 30 (see FIG. 3) extending in the front-rear direction are provided. Details of the lower shaft 20 and the connecting shaft 30 will be described below.

Figure 2:
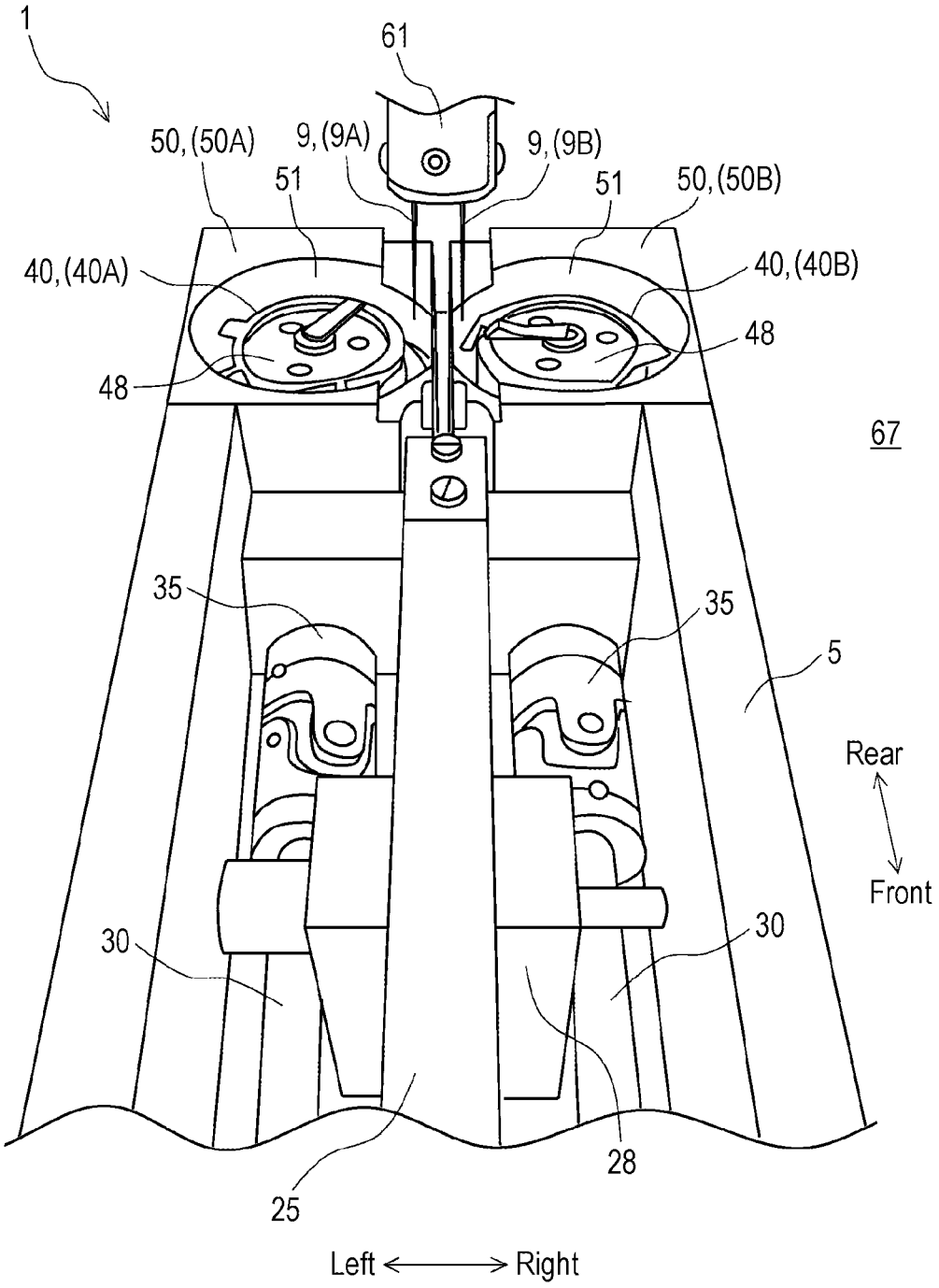
FIG. 2 is a perspective view illustrating a state in which a cover and a feed dog are removed near a tip of a lower arm portion of the double-needle lockstitch sewing machine according to the embodiment of the present invention.

FIG. 2 is a perspective view illustrating a state in which a cover and a feed dog 26 (see FIG. 4) near a tip of the lower arm portion 5 of the double-needle lockstitch sewing machine 1 are removed. As illustrated in FIG. 2, a pair of loop catchers 40 is provided inside near the tip of the lower arm portion 5 respectively corresponding to the pair of needles 9.

Specifically, the needles 9 are arranged in the left-right direction at a predetermined interval. A left loop catcher 40A is disposed on the left side of a left needle 9A, and a right loop catcher 40B is disposed on the right side of a right needle 9B.

The loop catchers 40 are arranged in hook receiving holes 51 respectively formed on upper surfaces of a pair of left and right hook receiving blocks 50, which is provided near the tip of the lower arm portion 5. The loop catcher 40 has a hook shaft 41 (see FIG. 5) extending substantially vertically, and is configured to rotate about the hook shaft 41. Then, as will be described in detail below, the loop catcher 40 rotates in conjunction with an up and down movement of the needle 9.

An outer hook provided in an upper portion of the loop catcher 40 has a sword tip 43 (see FIG. 6) for catching a loop of a needle thread, which is formed by the up and down movement of the needle 9. Further, inside the outer hook of the loop catcher 40, an inner hook in which a bobbin 48 wound with a bobbin thread is housed is provided.

The loop catcher 40 rotates in conjunction with the up and down movement of the needle 9, so that the loop of the needle thread sent below the fabric by the needle 9 penetrating the fabric is caught by the sword tip 43. Then, the loop of the needle thread caught by the sword tip 43 goes under the inner hook in which the bobbin 48 wound with the bobbin thread is housed. Thus, the needle thread and the bobbin thread intersect.

Then, the loop of the needle thread that has passed under the inner hook comes off from the sword tip 43 as the loop catcher 40 rotates. The needle thread is pulled up by a balance (not shown), so that the needle thread and the bobbin thread intersecting the needle thread are tightened inside the fabric. Thus, two rows of lockstitch seams are formed.

As described with reference to FIG. 1, the bed portion 2 of the double-needle lockstitch sewing machine 1 has a substantially U-shape in a plan view, and the bed portion 2 has the lower arm portion 5 formed to extend rearward. Then, as illustrated in FIG. 2, the loop catchers 40 are arranged near the tip of the lower arm portion 5. With such a configuration, the tubular article is easily sewn.

That is, it is possible to roll the fabric into a tubular shape so as to wrap the lower arm portion 5, and to feed the opposing sides in the axial direction of the fabric rolled into the tubular shape to near the tip of the lower arm portion 5 where the needles 9 and the loop catchers 40 are arranged. Thus, the tubular article can be easily sewn by sewing the opposing sides of the fabric rolled into the tubular shape.

As described above, according to the double-needle lockstitch sewing machine 1, the tubular article such as the sleeve of clothing, which was conventionally sewn by loop stitching, can be easily formed by lockstitch. The tubular article formed by lockstitch has less sewing threads exposed from the fabric and has high sewing strength. That is, according to the double-needle lockstitch sewing machine 1, it is possible to sew the tubular article with lockstitch seams, which is suitable for the sleeve of sportswear or the like, and is durable and nice and soft.

Figure 3:
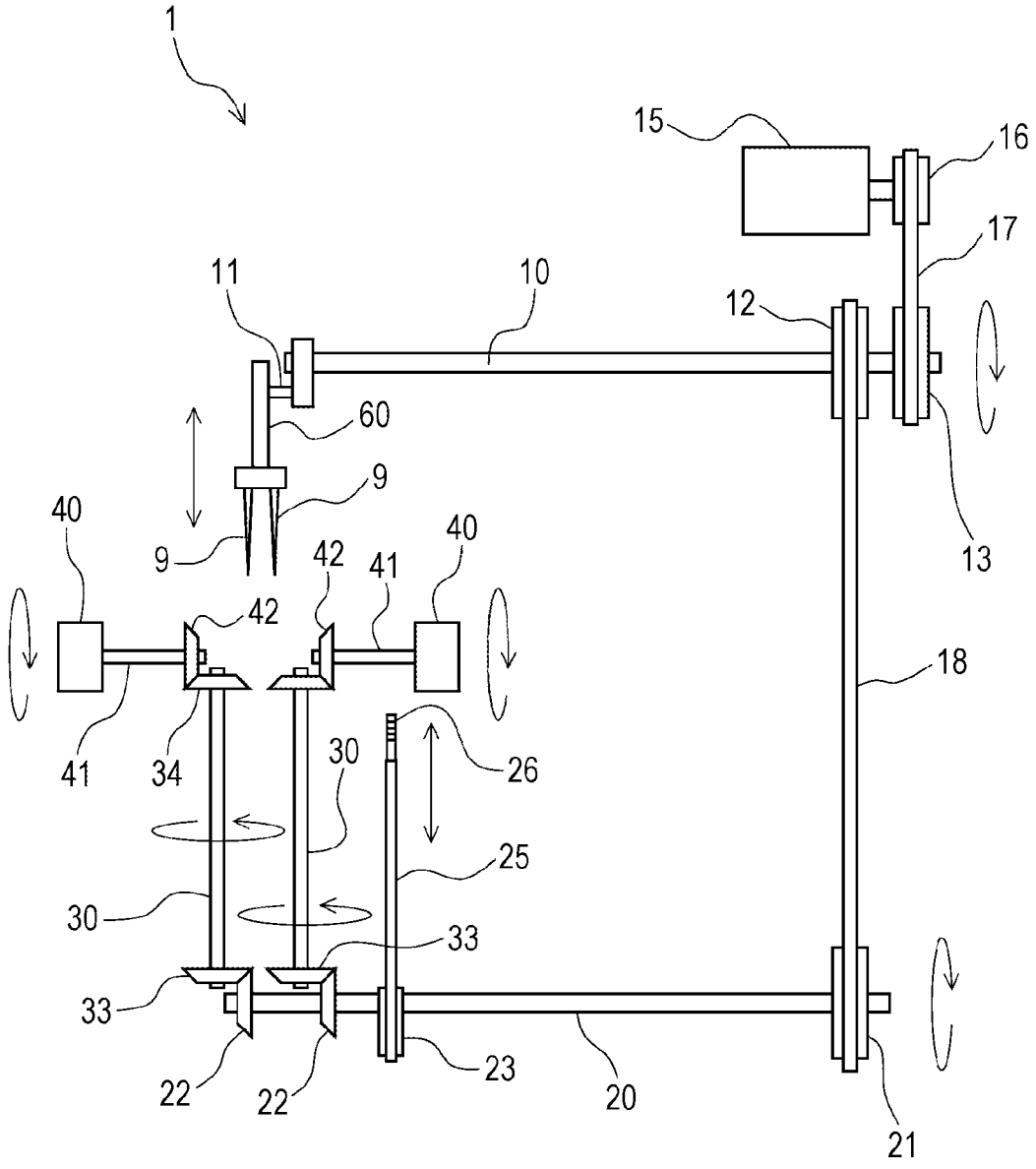
FIG. 3 is a schematic view illustrating an outline of a drive system of the double-needle lockstitch sewing machine according to the embodiment of the present invention.

FIG. 3 is a schematic view illustrating an outline of a drive system of the double-needle lockstitch sewing machine 1. As illustrated in FIG. 3, the double-needle lockstitch sewing machine 1 has the main shaft 10 for moving the needle 9 up and down. As described above, the main shaft 10 is provided inside the upper arm portion 7 (see FIG. 1), and extends substantially horizontally in the left-right direction.

The spindle 10 is connected to a motor 15 via a timing belt 17 and pulleys 13 and 16, and is rotationally driven by the motor 15. The needles 9 are connected to near a left end of the main shaft 10 via the needle driving link mechanism 11. Thus, the needles 9 reciprocate in the up-down direction by a rotation of the main shaft 10. The balance (not shown) is connected to the main shaft 10 so as to reciprocate via a link mechanism.

The double-needle lockstitch sewing machine 1 has the lower shaft 20 and the connecting shafts 30 for rotating the loop catchers 40. The lower shaft 20 is connected to the main shaft 10 via a timing belt 18 and pulleys 12 and 21. Thus, a rotational power is transmitted from the main shaft 10 to the lower shaft 20, and the lower shaft 20 rotates in conjunction with the main shaft 10.

The connecting shaft 30 is a rotating shaft that connects the hook shaft 41 of the loop catcher 40 and the lower shaft 20 so as to be able to transmit power. Thus, the rotational power of the lower shaft 20 is transmitted to the hook shaft 41 via the connecting shaft 30, and the loop catcher 40 rotates. As described above, the hook shaft 41 is the rotating shaft disposed substantially vertically.

Further, the lower shaft 20 is provided with a cam 23 for driving a feed rod 25 provided with the feed dog 26 near its tip. Thus, the feed dog 26 is driven by the rotation of the lower shaft 20 and repeatedly moves in the cloth feed direction and the up-down direction in a predetermined locus.

Figure 4:
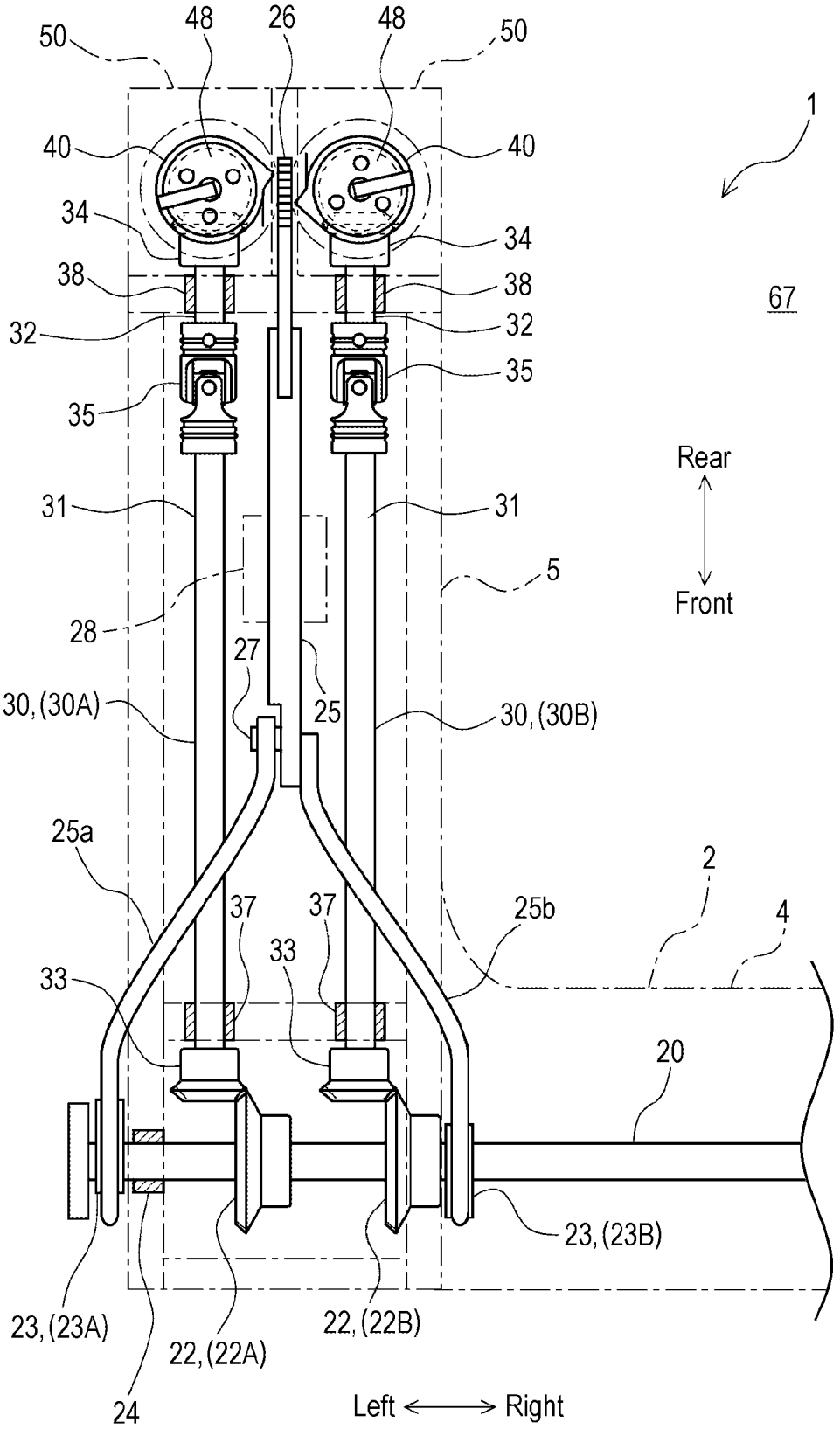
FIG. 4 is a plan view illustrating an arrangement of loop catchers, connecting shafts and a lower shaft in the double-needle lockstitch sewing machine according to the embodiment of the present invention.
Figure 5:
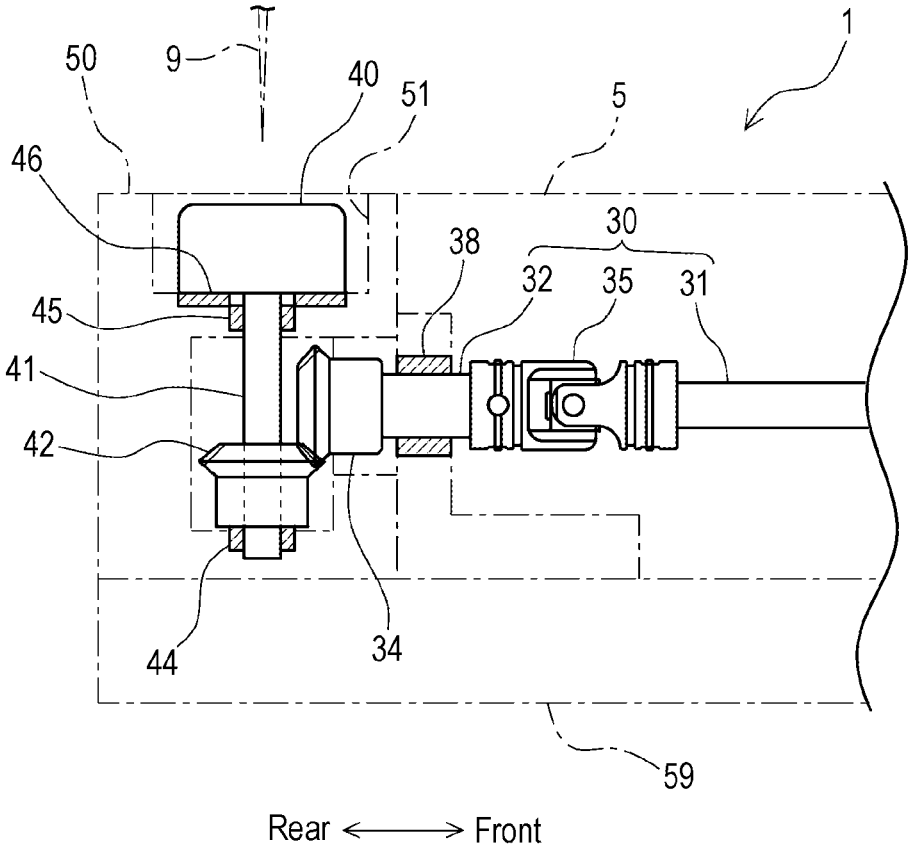
FIG. 5 is a left side view illustrating the arrangement of the loop catcher and the connecting shaft in the double-needle lockstitch sewing machine according to the embodiment of the present invention.

FIG. 4 is a plan view illustrating an arrangement of the loop catchers 40, the connecting shafts 30 and the lower shaft 20 in the double-needle lockstitch sewing machine 1. FIG. 5 is a left side view illustrating the arrangement of the loop catcher 40 and the connecting shaft 30 in the double-needle lockstitch sewing machine 1.

As illustrated in FIG. 4, the lower shaft 20 is provided inside the bed front portion 4 so as to be substantially parallel to the main shaft 10 (see FIG. 3). That is, the lower shaft 20 is substantially horizontal and extends in the left-right direction. The lower shaft 20 is rotatably supported by the bed portion 2 via a bearing 24 or the like, for example such as a sliding bearing or a rolling bearing.

A pair of connecting shafts 30 is arranged inside the lower arm portion 5. The pair of connecting shafts 30 is arranged side by side and extends substantially parallel to each other in the cloth feeding direction, that is, in the front-rear direction. That is, the connecting shafts 30 are provided substantially perpendicular to the lower shaft 20. The connecting shaft 30 is rotatably supported by the bed portion 2 via bearings 37 and 38, for example such as the sliding bearing or the rolling bearing.

A gear 33 is provided near a front end of each connecting shaft 30. The gear 33 meshes with a gear 22 provided near a left end of the lower shaft. On the other hand, a gear 34 is provided near a rear end of each connecting shaft 30. As illustrated in FIG. 5, the gear 34 meshes with a gear 42 attached to the hook shaft 41.

That is, as illustrated in FIGS. 4 and 5, the connecting shaft 30 is connected to the lower shaft 20 and the hook shaft 41 via gears 22, 33, 34, 42. Thus, the rotational power of the lower shaft 20 can be efficiently and accurately transmitted to the hook shaft 41, and the loop catcher 40 can be rotated with high accuracy. Therefore, suitable lockstitch seams can be formed.

In order to efficiently transmit the rotational power from the lower shaft 20 to the connecting shaft 30 which are substantially perpendicular to each other, and from the connecting shaft 30 to the hook shaft 41 which are substantially perpendicular to each other, the gears 22, 33, 34 and 42 are preferably bevel gears or helical bevel gears.

As illustrated in FIG. 5, the hook shaft 41 of the loop catcher 40 is rotatably supported by the hook receiving block 50 via bearings 44 and 45, for example such as the sliding bearing or the rolling bearing. Further, a thrust bearing 46 is provided in the hook receiving hole 51 of the hook receiving block 50. The thrust bearing 46 rotatably supports a bottom of the outer hook of the loop catcher 40. The thrust bearing 46 is preferably, for example, a needle bearing or the like that is thin and has low rolling resistance.

By providing the thrust bearing 46 between the loop catcher 40 and the hook receiving block 50, rotational resistance of the loop catcher 40 is reduced. Further, meshing of the gear 34 and the gear 42 can suitably support the loop catcher 40 against a downward thrust force acting on the hook shaft 41. This makes it possible to realize smooth and efficient rotation of the loop catcher 40.

As described with reference to FIGS. 1 to 5, in the double-needle lockstitch sewing machine 1 according to the present embodiment, the lower shaft 20 for rotating the loop catchers 40 is provided in front of the needles 9 and the loop catchers 40. Further, the loop catcher 40 is rotationally driven via the connecting shaft 30 extending in the front-rear direction.

Therefore, in the bed portion 2 of the double-needle lockstitch sewing machine 1, it is possible to secure a space for feeding the fabric in the left and right near the needles 9 and the loop catchers 40, where the fabric is sewn. That is, by disposing the lower shaft 20 in the bed front portion 4, it is possible to secure a space, specifically the recess 67, for passing the fabric behind the lower shaft 20 and below the main shaft 10.

With such a configuration, when sewing the tubular article, the fabric that is rolled into the tubular shape and fed is less likely to hit the bed portion 2. That is, since the bed portion 2 does not get in the way, even the tubular article having a relatively small diameter, for example such as the sleeve of clothing, can be easily sewn.

As illustrated in FIG. 4, the feed dog 26 for feeding the fabric to be sewn backward is disposed between the pair of loop catchers 40. The feed dog 26 is disposed between the pair of connecting shafts 30, and is fixed near a rear end of the feed rod 25 extending in the front-rear direction. The feed rod 25 is supported by a support portion 28 so as to be slidable in the front-rear direction and swingable in the up-down direction. As described above, the feed rod 25 is driven by the cam 23 fixed to the lower shaft 20.

A pair of cams 23 is provided near the left end of the lower shaft 20. The cams 23 are arranged to sandwich a pair of gears 22, on the outside in the left-right direction of the gears 22. That is, one cam 23A is provided on the left side of a left gear 22A for driving a left connecting shaft 30A. Further, the other cam 23B is provided on the right side of a right gear 22B for driving a right connecting shaft 30B.

A front portion of the feed rod 25 is divided into a left connecting portion 25*a* connected to the cam 23A on the left side and a right connecting portion 25*b* connected to the cam 23B on the right side. Specifically, the right connecting portion 25*b* is continuously and integrally formed from the feed rod 25. The left connecting portion 25*a* is connected to the feed rod 25 in a position-adjustable manner via a pin 27.

As a mechanism for driving the feed dog 26 is configured as described above, contact between the feed rod 25 or the like and the gear 22 or the like is avoided, and an arrangement interval of the pair of connecting shafts 30 is reduced, so that a width of the lower arm portion 5 in the left-right direction can be reduced. Thus, a shape of the lower arm portion 5 suitable for sewing the tubular article having a relatively small diameter such as the sleeve of clothing is formed.

As illustrated in FIGS. 4 and 5, the connecting shaft 30 has a drive shaft portion 31 connected to the lower shaft 20 via the gears 22 and 33, and a driven shaft portion 32 connected to the hook shaft 41 via the gears 34 and 42, and may be configured such that the drive shaft portion 31 and the driven shaft portion 32 are connected by a joint portion 35.

The joint portion 35 is a shaft joint capable of changing a shaft relative angle between the drive shaft portion 31 and the driven shaft portion 32. The joint portion 35 is preferably a universal joint, for example, such as a hook universal joint or a ball universal joint. Thus, even when an arrangement interval of the pair of loop catchers 40 is changed, the rotational power can be accurately and efficiently transmitted from the lower shaft 20 to the hook shaft 41 by changing the shaft relative angle between the drive shaft 31 and the driven shaft portion 32.

Figure 6:
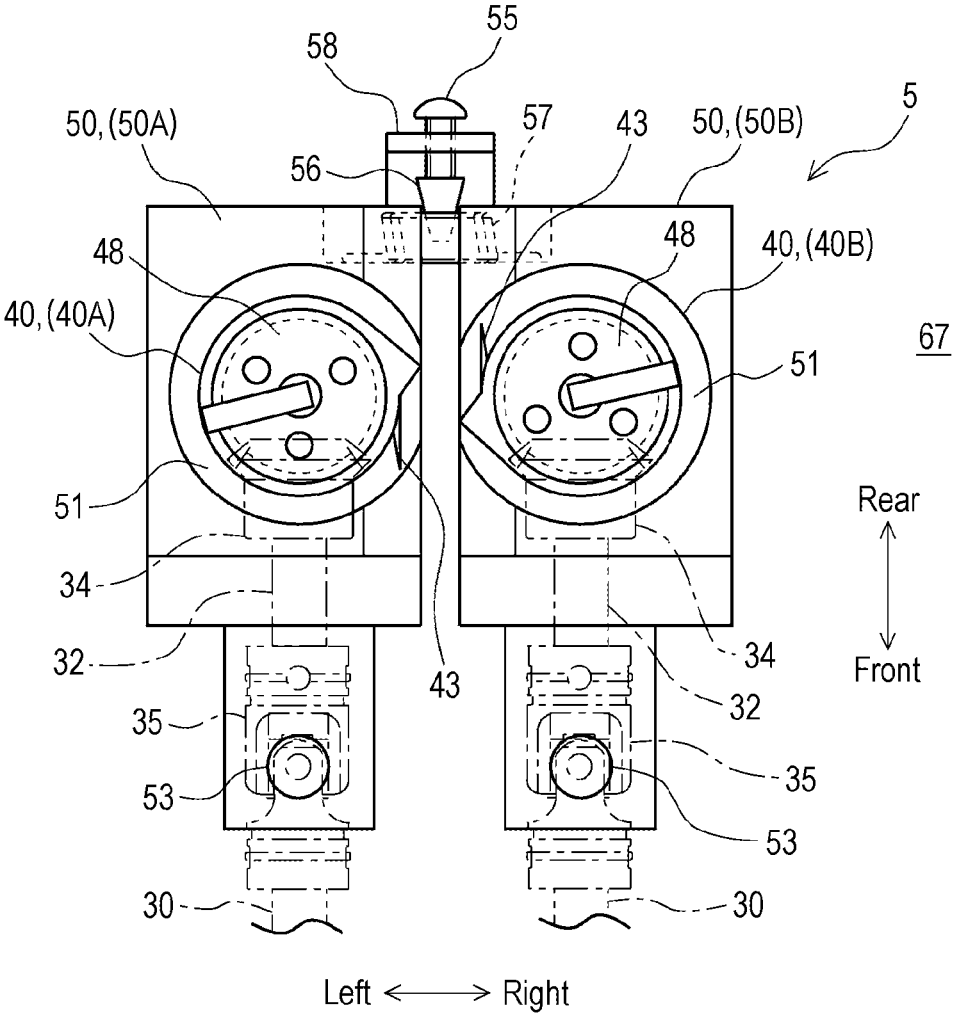
FIG. 6 is a plan view illustrating an arrangement of hook receiving blocks in the double-needle lockstitch sewing machine according to the embodiment of the present invention.
Figure 7:
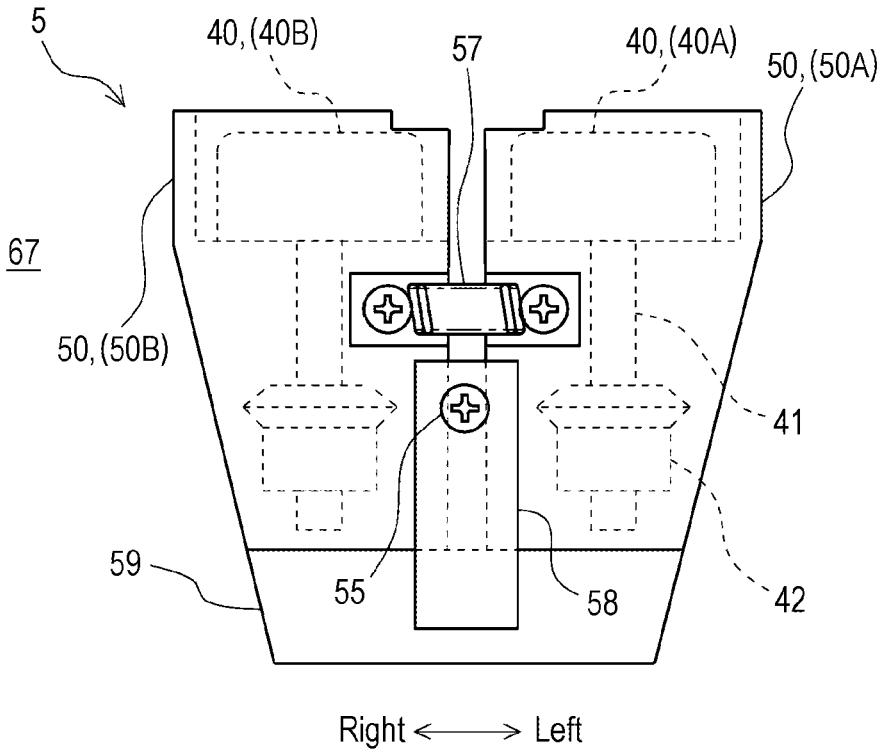
FIG. 7 is a rear view illustrating the arrangement of the hook receiving blocks in the double-needle lockstitch sewing machine according to the embodiment of the present invention.

FIG. 6 is a plan view illustrating the hook receiving blocks 50 of the double-needle lockstitch sewing machine 1. FIG. 7 is a rear view illustrating the hook receiving blocks 50. As illustrated in FIG. 6, a pair of hook receiving blocks 50 respectively having the loop catcher 40 disposed therein is supported by pins 53 so as to be swingable in a horizontal direction so that the arrangement interval of the loop catchers 40 can be adjusted.

The pin 53 is fixed to a base 59 of the lower arm portion 5 illustrated in FIG. 7. As illustrated in FIG. 6, the pin 53 is disposed at a position corresponding to the joint portion 35 of the connecting shaft 30. Thus, when an arrangement of the hook receiving block 50 is changed by rotating the hook receiving block 50 in the horizontal direction around the pin 53, the joint portion 35 changes the shaft relative angle between the drive shaft portion 31 and the driven shaft portion 32. As a result, the rotational power can be efficiently transmitted.

In the configuration shown in the above example, both a left hook receiving block 50A and a right hook receiving block 50B are movable. In this regard, at least one of the pair of hook receiving blocks 50 may be configured to be movable in the horizontal direction. If only one of the hook receiving blocks 50 is movable, the arrangement interval of the loop catchers 40 can be adjusted.

As illustrated in FIGS. 6 and 7, the pair of hook receiving blocks 50 is provided with an urging unit 57 that urges the pair of hook receiving blocks 50 in a direction that reduces the arrangement interval between them. The urging unit 57 is, for example, an elastic body such as a tension coil spring or rubber.

The urging unit may be, for example, a compression coil spring or other various elastic bodies, and urges to press the hook receiving blocks 50 from the outside in the left-right direction of the hook receiving blocks 50 so as to reduce an arrangement interval of the hook receiving blocks 50.

On a rear surface side of the hook receiving blocks 50, there are provided a spacer 56 as an adjusting unit, which is inserted between the pair of hook receiving blocks 50 to increase the arrangement interval of the hook receiving blocks 50, and an adjusting screw 55 for pressing the spacer 56 in between the hook receiving blocks 50.

The spacer 56 is, for example, a member having a substantially wedge shape, a substantially pyramidal shape, a substantially truncated pyramidal shape, a substantially conical shape, a substantially truncated cone shape, or the like, and has a width formed to gradually increase from the front end side to the rear end side inserted in between the hook receiving blocks 50.

The adjusting screw 55 is configured to be screwed into a threaded hole of a support member 58 attached to the base 59 and screwed forward in between the hook receiving blocks 50 to press the spacer 56.

With such a configuration, by screwing the adjusting screw 55, the spacer 56 is pressed forward and moved to be inserted in between the hook receiving blocks 50, so that the arrangement interval of the pair of loop catchers 40 can be easily increased.

On the other hand, by rotating the adjusting screw 55 in a reverse direction, the spacer 56 is moved in a direction of being pulled out from between the pair of hook receiving blocks 50, so that the pair of hook receiving blocks 50 is attracted by the urging unit 57, and thus the arrangement interval of the pair of loop catchers 40 can be easily reduced.

As described above, according to the double-needle lockstitch sewing machine 1 having the above configuration, the arrangement interval of the loop catchers 40 can be easily adjusted. Thus, the suitable lockstitch seams can be formed.

In the configuration shown in the above example, the urging unit 57, the adjusting screw 55, and the spacer 56 are attached to the rear side of the hook receiving block 50. In this regard, the urging unit 57, the adjusting screw 55 and the spacer 56 may be provided in other parts such as the front side of the hook receiving block 50. In the configuration in which the adjusting screw 55 is provided on the rear side of the hook receiving block 50 as described above, a head of the adjusting screw 55 is exposed from a rear surface of the lower arm portion 5. Therefore, this configuration is excellent in that it does not interfere with the sewing work and it is easy to perform work of adjusting the arrangement interval of the loop catchers 40.

Figure 8:
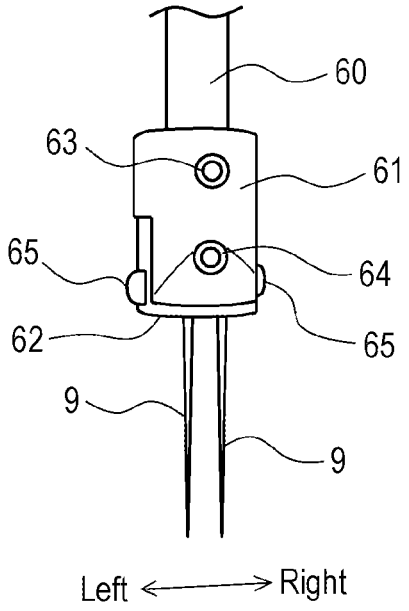
FIG. 8 is a perspective view illustrating a needle support and its vicinity of the double-needle lockstitch sewing machine according to the embodiment of the present invention.
Figure 9:
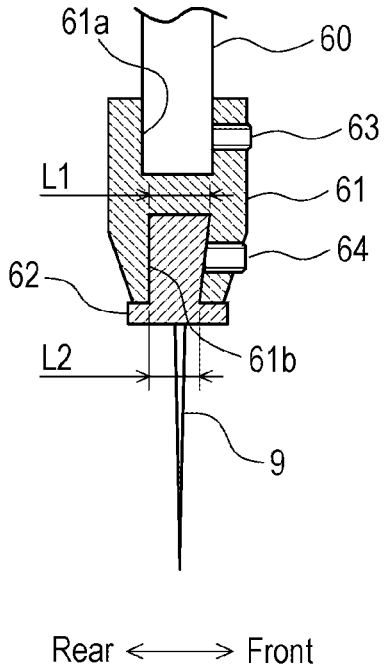
FIG. 9 is a left side cross-sectional view illustrating the needle support and its vicinity of the double-needle lockstitch sewing machine according to the embodiment of the present invention.
Figure 10:
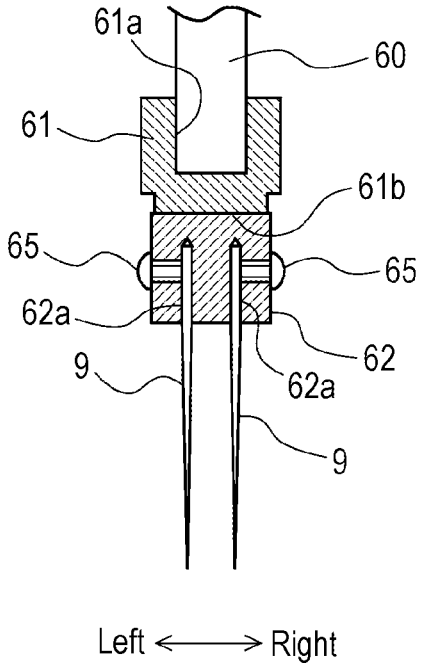
FIG. 10 is a front cross-sectional view illustrating the needle support and its vicinity of the double-needle lockstitch sewing machine according to the embodiment of the present invention.

FIGS. 8 to 10 are views illustrating a needle support 61 and its vicinity of the double-needle lockstitch sewing machine 1. FIG. 8 is a perspective view. FIG. 9 is a left side cross-sectional view at a center of the needle support 61. FIG. 10 is a front cross-sectional view at the center of the needle support 61.

As illustrated in FIG. 8, the pair of needles 9 is attached to near a lower end of a needle bar 60 connected to the needle driving link mechanism 11 (see FIG. 3) via the needle support 61. Specifically, as illustrated in FIGS. 9 and 10, the lower end of the needle bar 60 is fitted or screwed into a mounting hole 61*a* formed in an upper portion of the needle support 61, so that the needle support 61 is attached to the needle bar 60. Then, the needle support 61 is fixed to the needle bar 60 by a set screw 63.

A mounting groove 61*b* that opens downward and in the left-right direction is formed in a lower portion of the needle support 61. A needle fixture 62 to which the needle 9 is fixed is attached to the mounting groove 61*b*. Specifically, the needle fixture 62 is inserted into the mounting groove 61*b* by being slid from either the left or right side. Then, as illustrated in FIG. 9, the needle fixture 62 fitted in the needle support 61 is fixed by the set screw 64.

As illustrated in FIG. 10, needle mounting holes 62*a* are formed substantially parallel to each other and at a predetermined interval in a lower portion of the needle fixture 62, and upper ends of the pair of needles 9 are inserted into the needle mounting holes 62*a*. The needle 9 is fixed to the needle fixture 62 by the set screw 65. The needle 9 may be fixed to the needle fixture 62 in advance before the needle fixture 62 is attached to the needle support 61.

A width L1 that is a dimension in the front-rear direction of upper portion of the mounting groove 61*b* and the needle fixture 62 inserted therein is larger than a width L2 that is the dimension in the front-rear direction of a lower portion of the mounting groove 61*b*. Thus, it is possible to prevent the needle fixture 62 inserted by being slid horizontally from the left or right into the mounting groove 61*b* of the needle support 61 from falling off from the needle support 61. This facilitates work of attaching the needle fixture 62 to the needle support 61.

With the above configuration, the pair of needles 9 can be easily attached to an exact position at the lower end of the needle bar 60.

Next, with reference to FIGS. 11 to 14, another embodiment having a modified adjusting unit for increasing the arrangement interval of the hook receiving blocks 50 will be described in detail. Components having the same or similar actions and effects as those of the above-described embodiment are designated by the same reference numerals, and a description thereof will be omitted.

Figure 11:
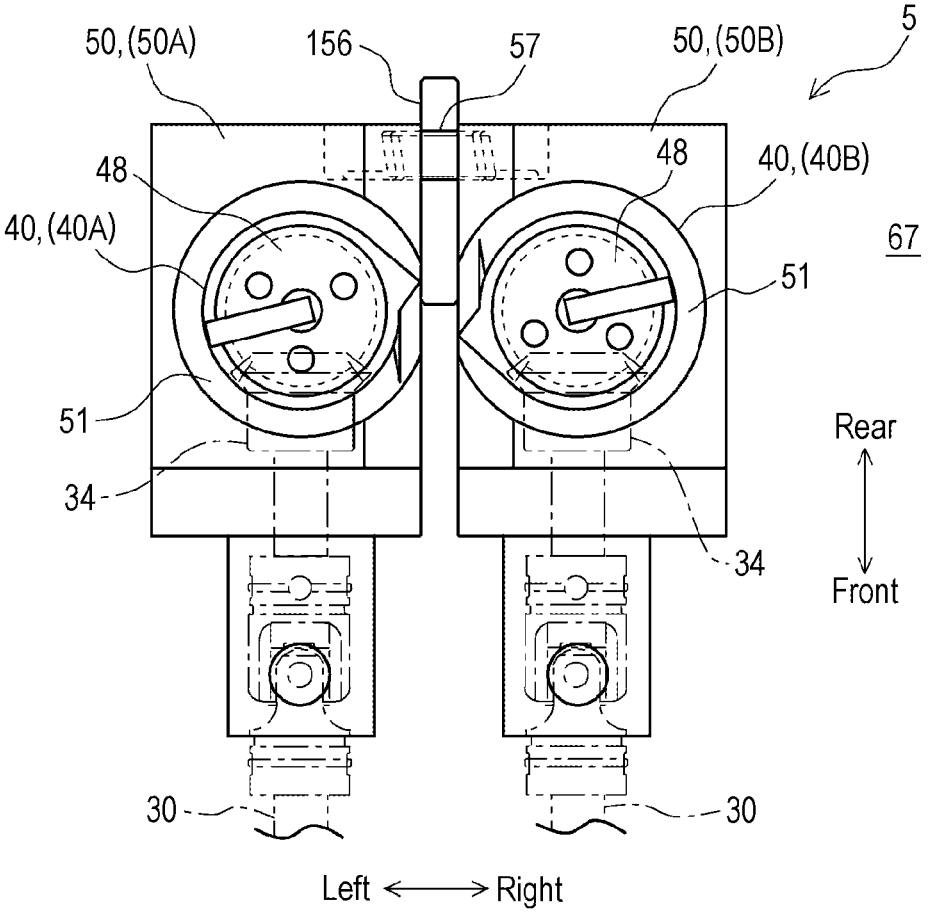
FIG. 11 is a plan view illustrating the arrangement of the hook receiving blocks in the double-needle lockstitch sewing machine according to another embodiment of the present invention.
Figure 12:
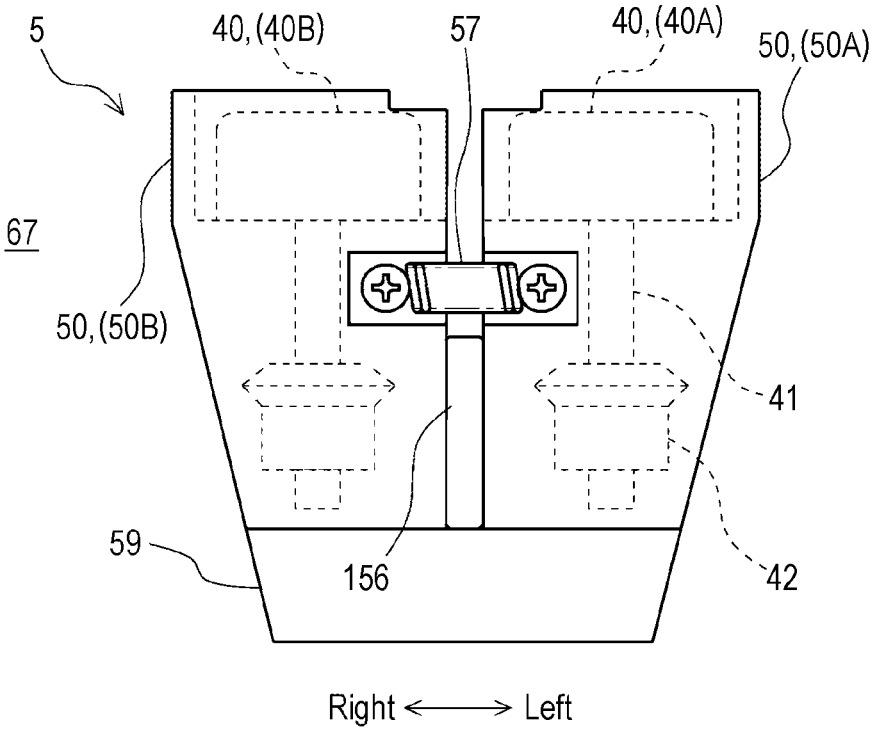
FIG. 12 is a rear view illustrating the arrangement of the hook receiving blocks in the double-needle lockstitch sewing machine according to another embodiment of the present invention.

FIG. 11 is a plan view illustrating the hook receiving blocks 50 of the double-needle lockstitch sewing machine 1. FIG. 12 is a rear view illustrating the hook receiving blocks 50. As illustrated in FIGS. 11 and 12, a spacer 156 having a substantially plate-like shape may be provided as the adjusting unit for adjusting the arrangement interval of the pair of hook receiving blocks 50.

Specifically, the spacer 156 is a member having a substantially plate-like shape, and is inserted between the pair of hook receiving blocks 50 so that one main surface thereof contacts the left hook receiving block 50A and the other main surface thereof contacts the right hook receiving block 50B.

The spacer 156 may have a substantially plate-like structure having one main surface in contact with the left hook receiving block 50A and the other main surface in contact with the right hook receiving block 50B. The spacer 156 may be, for example, a hollow cassette having a plate shape, or the like.

As described above, by inserting the spacer 156 between the pair of hook receiving blocks 50, the arrangement interval of the pair of hook receiving blocks 50 is increased according to a thickness dimension of the spacer 156. Then, the arrangement interval of the pair of loop catchers 40 is increased.

The spacer 156 is formed to have a predetermined thickness dimension so that the arrangement interval of the loop catchers 40 is a suitable value suitable for a target lockstitch. That is, a plurality of types of spacers 156 having different thickness dimensions is prepared depending on target lockstitch seams. Therefore, by replacing the spacer 156 according to the lockstitch seams to be formed, the arrangement interval of the pair of loop catchers 40 can be easily and accurately adjusted to a suitable state.

The spacer 156 or the hook receiving block 50 may have a support portion or the like formed to fix the spacer 156 inserted between the pair of hook receiving blocks 50 at a predetermined position. This facilitates work of attaching and detaching the spacer 156 and allows the spacer 156 to be held in an appropriate position.

Figure 13:
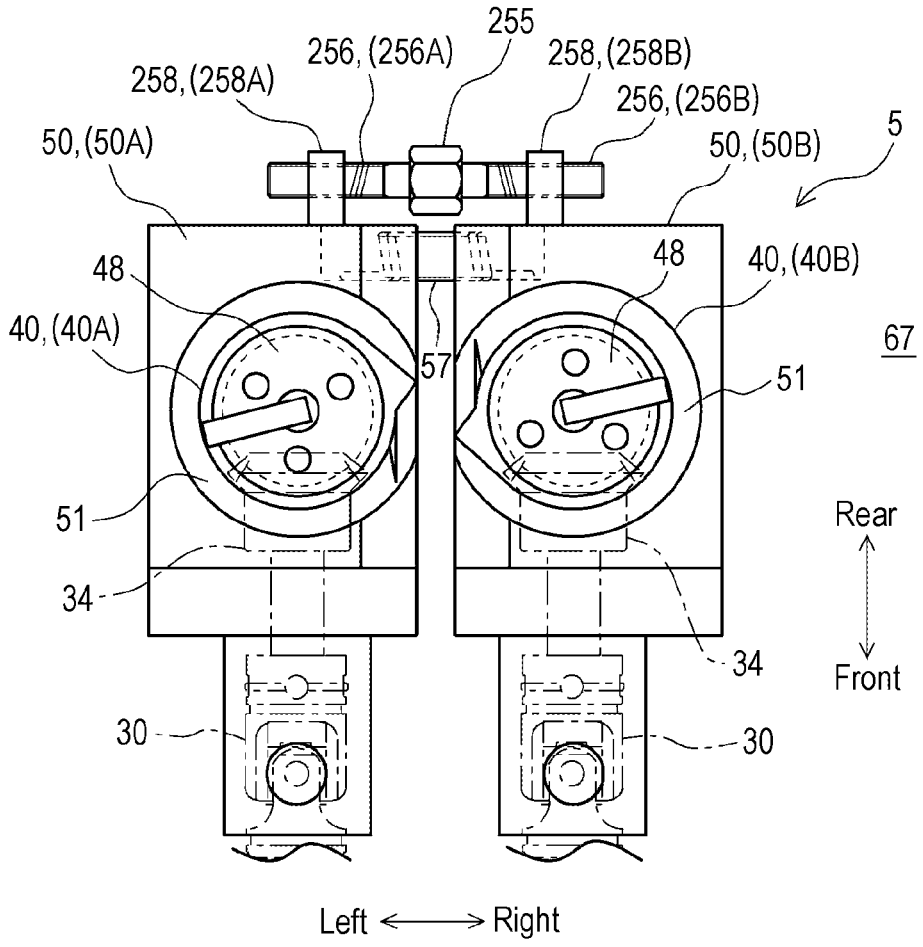
FIG. 13 is a plan view illustrating the arrangement of the hook receiving blocks in the double-needle lockstitch sewing machine according to another embodiment of the present invention.
Figure 14:
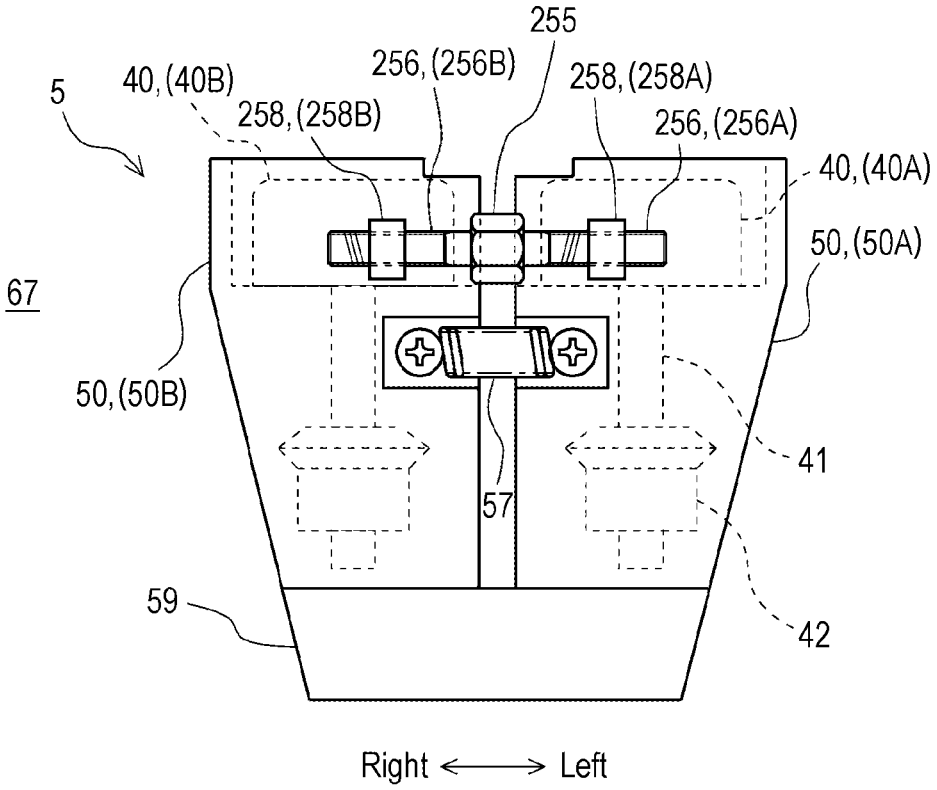
FIG. 14 is a rear view illustrating the arrangement of the hook receiving blocks in the double-needle lockstitch sewing machine according to another embodiment of the present invention.

FIG. 13 is a plan view illustrating the hook receiving blocks 50 of another embodiment having a modified adjusting unit for increasing the arrangement interval of the hook receiving blocks 50. FIG. 14 is a rear view illustrating the hook receiving blocks 50.

As illustrated in FIGS. 13 and 14, the pair of hook receiving blocks 50 is provided with an adjusting screw 255 as the adjusting unit for adjusting the arrangement interval thereof. The adjusting screw 255 has threaded portions 256 on both end sides of a screw shaft. The adjusting screw 255 is disposed on the pair of hook receiving blocks 50 so as to extend in the left-right direction.

That is, the pair of hook receiving blocks 50 has female threaded portions 258 into which the threaded portions 256 of the adjusting screw 255 are screwed. Here, a threaded portion 256A on one end side and a threaded portion 256B on the other end side of the adjusting screw 255 are formed to have opposite threads to each other. Then, a threaded hole of the female threaded portion 258A provided on the left hook receiving block 50A and a threaded hole of the female threaded portion 258B provided on the right hook receiving block 50B are formed to have opposite threads to each other correspond to the threaded portions 256 of the adjusting screw 255.

Specifically, for example, the threaded hole of the female threaded portion 258A provided on the left hook receiving block 50A and the threaded portion 256A on the one end side of the adjusting screw 255 screwed therein are formed to have a left-handed thread. On the other hand, the threaded hole of the female threaded portion 258B provided on the right hook receiving block 50B and the threaded portion 256B on the other end side of the adjusting screw 255 screwed therein are formed to have a right-handed thread.

In this way, the pair of hook receiving blocks 50 is connected by the adjusting screw 255 having both ends formed in opposite threads to each other. Thus, the arrangement interval of the pair of hook receiving blocks 50 can be easily adjusted by rotating the adjusting screw 255.

Specifically, by rotating the adjusting screw 255 in one rotational direction, the threaded portions 256 on the both ends can be screwed into the threaded holes of the female threaded portions 258 on the left and right sides, so that the arrangement interval of the pair of hook receiving blocks 50 can be reduced. On the other hand, by rotating the adjusting screw 255 in a rotational direction opposite to the above, the arrangement interval of the pair of hook receiving blocks 50 can be increased. Therefore, the arrangement interval of the pair of loop catchers 40 can be easily increased.

As described above, according to the double-needle lockstitch sewing machine 1 having the above configuration, the arrangement interval of the loop catchers 40 can be easily adjusted.

The present invention is not limited to the above-described embodiments, and various modifications can be made without departing from the gist of the present invention.

LIST OF REFERENCE SIGNS

1: Double-needle lockstitch sewing machine, 2: Bed portion, 3: Base portion, 4: Bed front portion, 5: Lower arm portion, 6: Support column, 7: Upper arm portion, 8: Jaw portion, 9: Needle, 10: Main shaft, 15: Motor, 20: Lower shaft, 22: Gear, 23: Cam, 25: Feed rod, 25*a*: Left connecting portion, 25*b*: Right connecting portion, 26: Feed dog, 30: Connecting shaft, 31: Drive shaft portion, 32: Driven shaft portion, 33: Gear, 34: Gear, 35: Joint portion, 40: Loop catcher, 41: Hook shaft, 42: Gear, 50: Hook receiving block, 55: Adjusting screw, 56: Spacer, 57: Urging unit, 156: Spacer, 255: Adjusting screw, 256: Threaded portion, 258: Female threaded portion.

The invention claimed is:

1. A double-needle lockstitch sewing machine comprising:

a pair of needles that are arranged at a predetermined interval in a left-right direction with respect to a cloth feeding direction and reciprocate in an up-down direction;

a pair of loop catchers that is arranged respectively corresponding to the pair of needles and that catch loops of needle threads formed by the needles by rotating about hook shafts extending in the up-down direction;

a lower shaft that is disposed in front of the needles and the loop catchers in the cloth feeding direction and extends in the left-right direction and that rotates in conjunction with a main shaft that drives the needles;

connecting shafts that extend in the cloth feeding direction and are connected to the lower shaft and the hook shafts in a power transmittable manner to rotate;

a pair of hook receiving blocks configured such that the loop catchers are respectively arranged therein and at least one of them is movable;

an urging unit that urges the pair of hook receiving blocks in a direction that reduces an arrangement interval thereof; and an adjusting unit that adjusts the arrangement interval of the pair of hook receiving blocks, wherein the loop catchers are rotationally driven in conjunction with an up and down movement of the needles as a rotational power of the lower shaft is transmitted to the hook shafts via the connecting shafts, and the arrangement interval of the pair of loop catchers can be changed.

2. The double-needle lockstitch sewing machine according to claim 1, comprising:

a bed portion in which the lower shaft is disposed;

a support column erected upward from the bed portion;

an upper arm portion that is provided on an upper portion of the support column, extends in the left-right direction, and has the main shaft disposed therein; and a jaw portion provided near a tip of the upper arm portion and on which the needles are arranged, wherein the bed portion has a lower arm portion formed to extend in the cloth feeding direction from a bed front portion in which the lower shaft is disposed, and to reach below the jaw portion, and the connecting shafts are arranged inside the lower arm portion, and the loop catchers are arranged near a tip of the lower arm portion.

3. The double-needle lockstitch sewing machine according to claim 1, wherein the connecting shafts are connected to the lower shaft and the hook shafts via gears.

4. The double-needle lockstitch sewing machine according to claim 1, wherein the connecting shaft has a drive shaft portion connected to the lower shaft, a driven shaft portion connected to the hook shaft, and a joint portion that connects the drive shaft portion and the driven shaft portion with a variable shaft relative angle.

* * * * *